United States Patent [19]

Takagi et al.

[11] 4,101,862

[45] Jul. 18, 1978

[54] CURRENT LIMITING ELEMENT FOR PREVENTING ELECTRICAL OVERCURRENT

[75] Inventors: Katsuyuki Takagi, Ichinomiya; Chihiro Asano, Kakamigahara, both of Japan

[73] Assignee: K.K. Tokai Rika Denki Seisakusho, Japan

[21] Appl. No.: 743,321

[22] Filed: Nov. 19, 1976

[51] Int. Cl.[2] ..... H01C 7/13; H01C 7/02

[52] U.S. Cl. ..... 338/23; 338/20; 338/22 R

[58] Field of Search ..... 338/20–25, 338/223–225; 361/26, 27, 127; 219/528, 552, 553, 504, 505; 29/612, 613; 252/511–514

[56] References Cited

U.S. PATENT DOCUMENTS

| | | | |
|---|---|---|---|
| 3,138,686 | 6/1964 | Mitoff et al. | 29/612 X |
| 3,164,796 | 1/1965 | Dixon | 252/511 X |
| 3,238,355 | 3/1966 | Van Eeck | 219/528 |
| 3,243,753 | 3/1966 | Kohler | 338/22 R X |
| 3,382,574 | 5/1968 | Chadwick | 29/613 X |
| 3,745,507 | 7/1973 | Ishida et al. | 338/25 |
| 3,793,716 | 2/1974 | Smith-Johannsen | 338/20 X |

*Primary Examiner*—C. L. Albritton
*Attorney, Agent, or Firm*—Koda and Androlia

[57] ABSTRACT

A current limiting element for preventing electrical overcurrent manufactured by mixing conductive particles with an elastic insulating material which possesses a positive coefficient of thermal expansion, such that particles are normally in electrical contact with each other, and the elastic material interposed between the particles is caused by heating to expand so that the electric circuit is interrupted.

14 Claims, 16 Drawing Figures

CURRENT LIMITING ELEMENT FOR PREVENTING ELECTRICAL OVERCURRENT

BACKGROUND OF THE INVENTION

1. Field of the Invention

This invention relates to current limiting elements for preventing electrical overcurrent and more particularly to reuseable current limiting elements.

2. Prior Art

Although conventional fuses which use fusible materials are small, light and inexpensive, they are unsuitable for use in circuits in which there is an abrupt influx of current such as motor driving circuits or switching circuits or incandescent lamps, etc., due to the fact that the abritrary establishment of the thermal time constant of the fuse is difficult. Furthermore, once the fuse has blown, it cannot be reused. On the other hand, thermal time constant can be changed as desired in bimetallic or electromagnetic types of circuit breakes which are presently in common use. These are also superior in terms of responsiveness and reliability but these circuit breakers require a large amount of space and are also expensive.

SUMMARY OF THE INVENTION

Accordingly, it is the general object of the present invention to provide a current limiting device which is easy to manufacture and low in cost.

It is another object to the present invention to provide a current limiting device which is reuseable.

It is still another object of the present invention to provide a current limiting device which is small in size.

It is yet another object of the present invention to provide a current limiting device which is responsive and reliable.

In keeping up with the principles of the present invention, the objects are accomplished with a unique current limiter device for perventing an electrical overcurrent manufactured by mixing conductive particles with an elastic insulative material which possesses a high positive coefficient of thermal expansion, such that the particles are normally in electrical contact with each other, and the elastic material underposed between the particles is caused by heating of the elastic material to expand so that the electric circuit is interrupted.

BRIEF DESCRIPTION OF THE DRAWING

The above-mentioned features and objects of the present invention will become more apparent by reference to the following description taken in conjunction with the accompanying drawings, wherein like reference numerals denote like elements and in which.

DETAILED DESCRIPTION OF THE INVENTION

Figure 1:
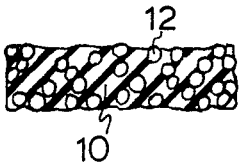
FIG. 1 is one embodiment of a current limiting device in accordance with the teachings of the present invention.
Figure 2:
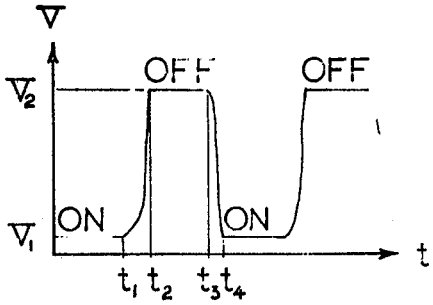
FIG. 2 is a graphical representation of the operation of the current limiting device of FIG. 1.

Referring to FIG. 1, shown therein is one embodiment of a current limiting device in accordance with the teachings of the present invention. In FIG. 1 the current limiting device includes a cylindrical conductor 10. This cylindrical conductor 10 is manufactured by mixing particles suitable for use as a conductive material such as gold, silver or a substance such as gold or silver plated onto another material, etc., with a substance such as silicone rubber, etc., which has a high coefficient of thermal expansion and is monothermally stable. When current is caused to flow through both ends of the conducting part 10, the internal heat generation is caused by the contact resistance between the particles. The elastic insulating material interposed between the particles undergoes thermal expansion, and the current is eventually interrupted. In this embodiment, since the internal heat generation is interrupted when the current is interrupted, the element will cool down until the particles make contact with each other, whereupon the current flowing action will be repeated as described above. As shown is FIG. 2, the on and off actions are alternately repeated. Specifically, since the temperature of the conductor 10 is low during the initial stage of conduction through the conductor 10, the particles 12 are close together. As a result of this, the internal voltage drop $\overline{V}$ across the conductor 10 is a low value and good conductivity is indicated. At conduction time $t_1$ the conductor 10 begains to expand due to the Joule heat arising from the conduction up to that point. At time $t_2$, the expansion of conductor 10 reaches a magnitude which breaks the mutual contact between the particles, and the current interrupted. The large internal voltage drop at this time is indicated by $\overline{V}_2$. When the circuit is thus broken, the conductor 10 radiates heat. Conductivity begins to recover at time $t_3$ and is restored completely at time $t_4$.

Thus, in this embodiment the period of interruption and continuity are repeated in an Oscillatory manner. However, a device designed so that it maintains the interruption of the circuit once the circuit has been interrupted can easily be provided. Such a device consists of a principal current conducting part consisting of a low-resistance conductive elastic material manufactured by mixing conductive particles with an elastic insulating material and a heating/heat insulating part, consisting of a high-resistive conductive elastic material or a resistive coating, which surrounds the circumference of the principal current conducting part. This heating/heat insulating part is for the purpose of causing sufficient heat generation to maintain the interrupted condition of the principal current conducting part. When a current flows through the principal current conducting part, the portion of the low-resistance conductive elastic material surrounded by the heating-/heat insulating part, undergoes a thermal expansion due to the heat generated by the contact resistance between the conductive particles, so that the current is interrupted. Furthermore, the device is designed so that the conducting part cools down in a given period of time after the voltage applied to the element is eliminated, and is thereby returned to a conductive condition. Thus, this invention provides, at a moderate cost, a small, durable current limiting element for preventing any electrical overcurrent which combines the merits of both conventional fuses and conventional circuit breakers.

Figure 3:
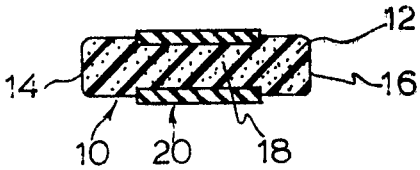
FIG. 3 is a second embodiment of a current limiting device in accordance with the teachings of the present invention.
Figure 4:
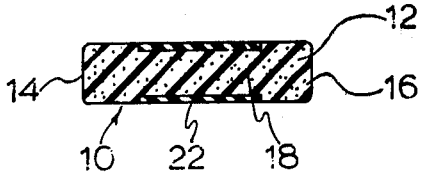
FIG. 4 is a third embodiment of a current limiting device in accordance with the teachings of the present invention.

In FIG. 3, is shown a second embodiment of a current limiting device in accordance teaching of the present invention. In FIG. 3, the cylindrical conductive elastic part 10 consist of terminal part 14 and 16 and principal current conducting part 18, and is manufactured by mixing conductive metallic particles of a substance such as gold, silver, platinum, etc., which is highly conductive and which is either unaffected by oxidation or corrosion, or is a meterial in which form compounds by oxidation or corrosion which are conductive, with a base material, such as silicone rubber, etc., which has a high coefficient of thermal expansion, is heat resistant, and whose material properties are stable at high temperatures. Furthermore, the elastic conductive part 10 formed so that the particles 12 are normally in contact with each other, and thus has a low resistance. In this embodiment, a heating/heat insulating member 20 covers and is provided on the circumference of the principal current conducting part 18. This consists either of a high-resistance conductive member of elastic material formed by mixing a high-resistance powdered metal such as nickel-chromium alloy or powdered carbon black with a base material of silicone rubber or as shown in FIG. 4 by resistive coating whose principle ingredient is carbon black deposited directly upon the circumferential surface of the principal current conducting part 18. Furthermore, the installation of this heating/heat insulating part 20 or 22 is as will be described below, is for the purpose of sealing into the principal current conducting part 18 the Joule heat generated when an overcurrent flows through the conducting part 18. It is also for the purpose of imparting just enough heat to the principal current conducting part 18, after the circuit is broken, to insure that the interruption of current is maintained. This is accomplished by means of Joule heat which is generated by allowing a very small amount of current to flow through the heating/heat insulating part 20 or 22 after the principal current has been interrupted. Accordingly, the heating/heat insulating part must possess a high resistance value and a low coefficient of overall heat transmission, and also a high stability at high temperatures.

Figure 5:
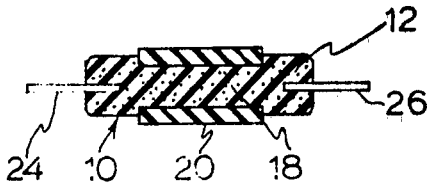
FIG. 5 is a fourth embodiment of a current limiting device in accordance with the features of the present invention.
Figure 6:
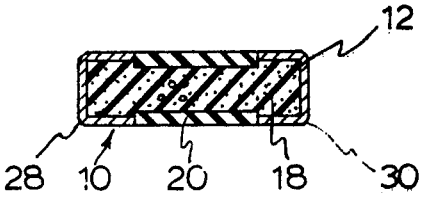
FIG. 6 is a fifth embodiment of a current limiting device in accordance with the teachings of the present invention.

Referring to FIGS. 5 and 6 shown therein are fourth and fifth embodiments of the present invention. In these embodiments, electrical contact with terminal parts 14 and 16 of the principal current conducting part 18 is obtained by means other than pressing the conducting part 18 and external terminal together. In FIG. 5, metallic terminals are inserted into both ends of the conductive elastic part 10 to form terminals 24 and 26. In FIG. 6, cap like metallic terminals are simultaneously formed on both ends of the elements to form terminal 28 and 30.

The following is a general description of the operation of the above-disclosed embodiments.

Figure 7:
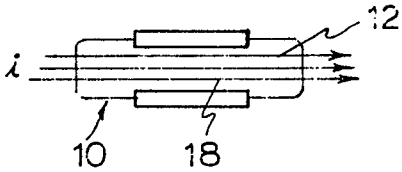
FIG. 7 is a representation of the normal current flow through the current limiting device in accordance with the teachings of the present invention.
Figure 9:
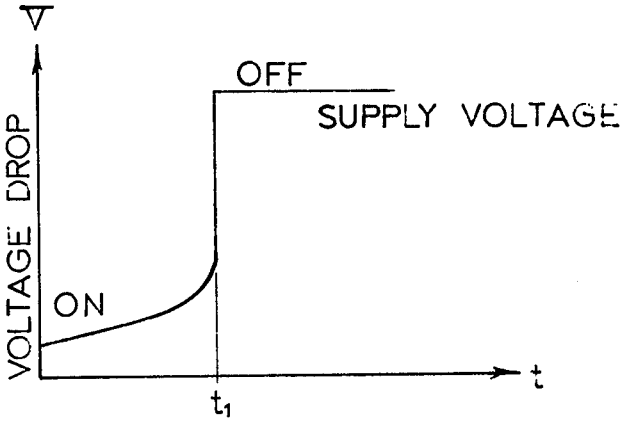
FIG. 9 is a graphical representation of the operation of the current limiting device in accordance of the teachings of the present invention.

When, as shown in FIG. 7, a normal current is flowing through the principal current conducting part 18 and the terminal parts 14 and 16 at both ends of the conducting part 18, the conducting element 18 undergoes absolutely no change. However, when an overcurrent flows through the conducting part 18, the affected portion of the elastic material undergoes thermal expansion due to the Joule heat generated in the principal current conducting part 18 by this overcurrent. This thermal expansion decreases the density of the individual conductive metallic particles 12 contained in the principal current conducting part 18 so that the contact resistance between the particles is increased. As a result, the Joule heat generated by the overcurrent is increased and the thermal expansion of the principal connecting part 18 is further accelerated. Since the conductive elastic part 10 expands rapidly as the above phenomenon is repeated, the mutual contact between the metallic particles is eventually broken and the conducting circuit is interrupted as shown in FIG. 9.

Figure 8:
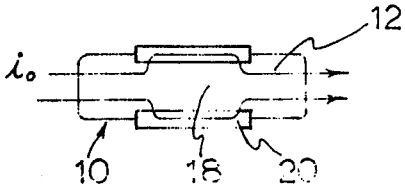
FIG. 8 is a representation of the current flowing in a current limiting device in accordance with the teachings of the present invention during a overload condition.

In this case, the interruption of current occurs along a plane perpendicular to the direction of principal current flow in the principal current conducting part 18. After the principal current has been interrupted, a very small amount of current $i_0$, as shown in FIG. 8, flows through the heating/heat insulating part 20 which surrounds the principal current conducting part 18. The vicinity of the plane of interruption is heated and heat insulated by the Joule heat generated by this very small amount of current flowing through the heating/heat insulating part 20 so that the interruption of the principal current is maintained. This electrical alteration is shown in FIG. 9. In particular, immediately prior to interruption ($t_1$) the voltage drop across the current limiting element increases abruptly and the electrical power loss inside the current limiting device increases until the interruption point is reached. This condition continues until the current supply is cut and the source of overcurrent is eliminated. When the power source is subsequently cut off for the time being, the principal current conducting part 18 will gradually cool down and return to the normal conduction state and a conducting circuit will once again be complete.

Figure 10:
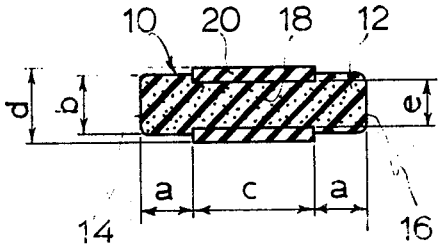
FIG. 10 is a detailed drawing of one embodiment of a current limiting device in accordance with the teachings of the present invention used for illustration purposes.
Figure 11:
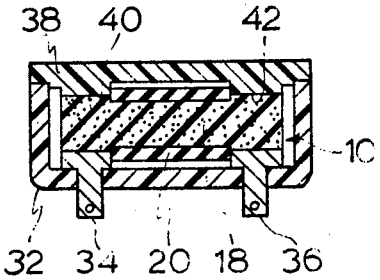
FIG. 11 is a test fixture utilized to test the operation of the current limiting device FIG. 10.

The following is a description, with reference to FIGS. 10 and 11, of one example of the characteristics obtained when a current limiting element for preventing electrical overcurrent in accordance with the teachings of the present invention was tested by being subjected to an overcurrent. The form of the test material used in this test was identical to that of the embodiment shown in FIG. 3. As shown in FIG. 11, the test assembly was connected as follows. Terminal parts 14 and 16 were connected by pressing them between fixed terminals 34 and 36 installed at both ends of the bottom of an insulating case 32 and projections 40 and 42 on the cover 38. The dimensions of the current limiting element are given in Table 1 below. The test results are shown in the Table 2.

TABLE 1

| | Length in axial* direction | External* diameter | Internal* diameter |
|---|---|---|---|
| Terminal parts (14, 16) | a = 3 | b = 5 | — |
| Heating/heat insulating part (20) | c = 10 | d = 6 | e = 4 |

*Units: millimeters

TABLE 2

(1) Initial interruption current: 7 ± 1 amperes (However, this was measured in 1-ampere steps.)
(2) Maintenance current flowing through the heating-/heat insulating part (20) after interruption: Approximately 150 milliamperes.
(3) Test cycle: First, a current twice the magnitude of the initial interruption current in (1) was caused to flow, so that the circuit was interrupted. After leaving the device in its interrupted condition with continued voltage supply for three minutes, the power supply was cut, and the device was allowed to cool for 27 minutes. In other words, one cycle lasted 30 minutes.

The above is one example of test results obtained from a overcurrent preventing element in accordance with the teachings of the present invention. In general, however, the value of current required for interruption may be arbitrarily selected by varying the cross-sectional area of the principal current conducting part 18 and the mixture of ratio of conductive metallic particles and silicone rubber, etc.

Furthermore, since the action of the element provided by this invention is an interrupting action caused by thermal expansion due to a rise in temperature, it can also be activated by heating by a means other than electrical current. It could be installed adjacent to the external wall of a motor, etc., and externally heated by the overheating of the motor. Accordingly, it would also be effective as an element for preventing overheating.

Figure 12:
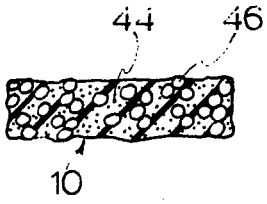
FIG. 12 is a cross-sectional view of a sixth embodiment of a current limiting device in accordance of the teachings of the present invention.
Figure 13:
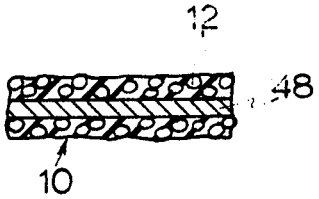
FIG. 13 is a cross-sectional view of a seventh embodiment of the current limiting device in accordand with the teachings of the present invention.

Also, since the size and shape of the element and the mixture ratio, particle diameter, etc., of the conductive particles can be selected as desired, this invention has the advantage of allowing control of the thermal time constant up to the point of interruption, in addition to being able to interrupt the current. Therefore, electrical characteristics adapted to the thermal time constant of the load are easily obtainable. Furthermore, although the above description mainly concerns an embodiment in which the part providing the heat insulation during interruption was wrapped around the circumference of the principal current connected to part 18, it goes without saying that the same effect could be also obtained by combining the principal conduction interrupting part and the heating/heat insulating part into one of the same part. As shown in FIG. 12 this could be accomplished by mixing a high-resistance powdered conductor 44 such as powdered carbon, powdered nickel-chromium alloy, etc., in with the principal conductive particles 46 within the conductive elastic part 10. As shown in FIG. 13, the same effect could be obtained by inserting a cylindrical core of resistive heat generating material 48 inside the current interrupting device.

Figure 14:
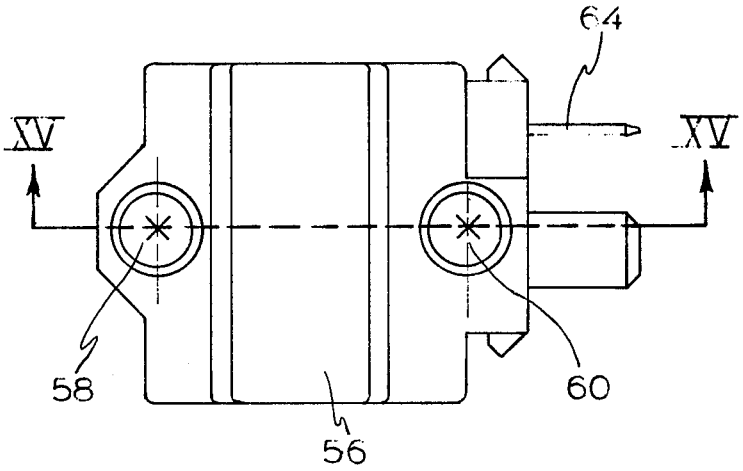
FIG. 14 is a eighth embodiment of a current limiting device in accordance with the teachings of the present invention
Figure 15:
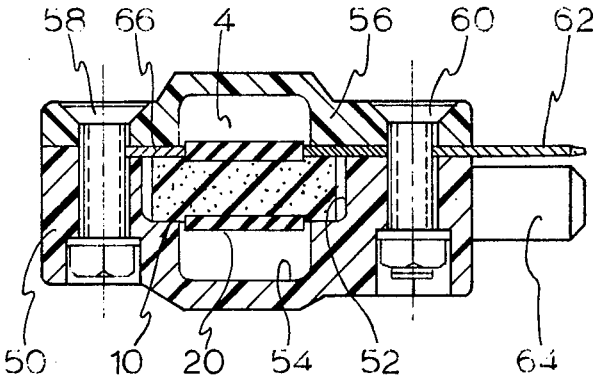
FIG. 15 is a cross-sectional view of the embodiment of FIG. 14.

Referring to FIGS. 14 and 15, shown therein is on eighth embodiment of a current limiting element in accordance with the teachings of the present invention provided within a case. The current limiting element includes conductive elastic member 10 and heating-/heat insulating part 20.

The conductive elastic part 10 is inserted into an opening 52 built into the interior of the case 50 which is made of an insulating material. A recess 54 which connects with the opening 52 is provided in the case 50, so that the heating/heat insulating part 20 is prevented from coming into contact with the case 50.

The case cover 56 is fasten to the case 50 by the means of screws 58 and 60. When the case cover 56 is fastened to the case 50, the terminal plates 62, 64 and 66 are at the same time inserted between the case 50 and the case cover 56. One end of terminal plate 62 is pressed against one end of the conductive elastic part 10, so that electrical continuity is ensured. One end of terminal plate 66 is pressed against the other end of the conductive elastic part 10 and the other end of terminal plate 66 is soldered to terminal plate 64. Accordingly, when the terminal plates 62 and 64 are connected with a principal current source of an electric circuit, the principal current will flow from the terminal plate 62 through the element 10 and the terminal plate 66 to terminal plate 64, and thus the overcurrent will be prevented from flowing to the load.

Figure 16:
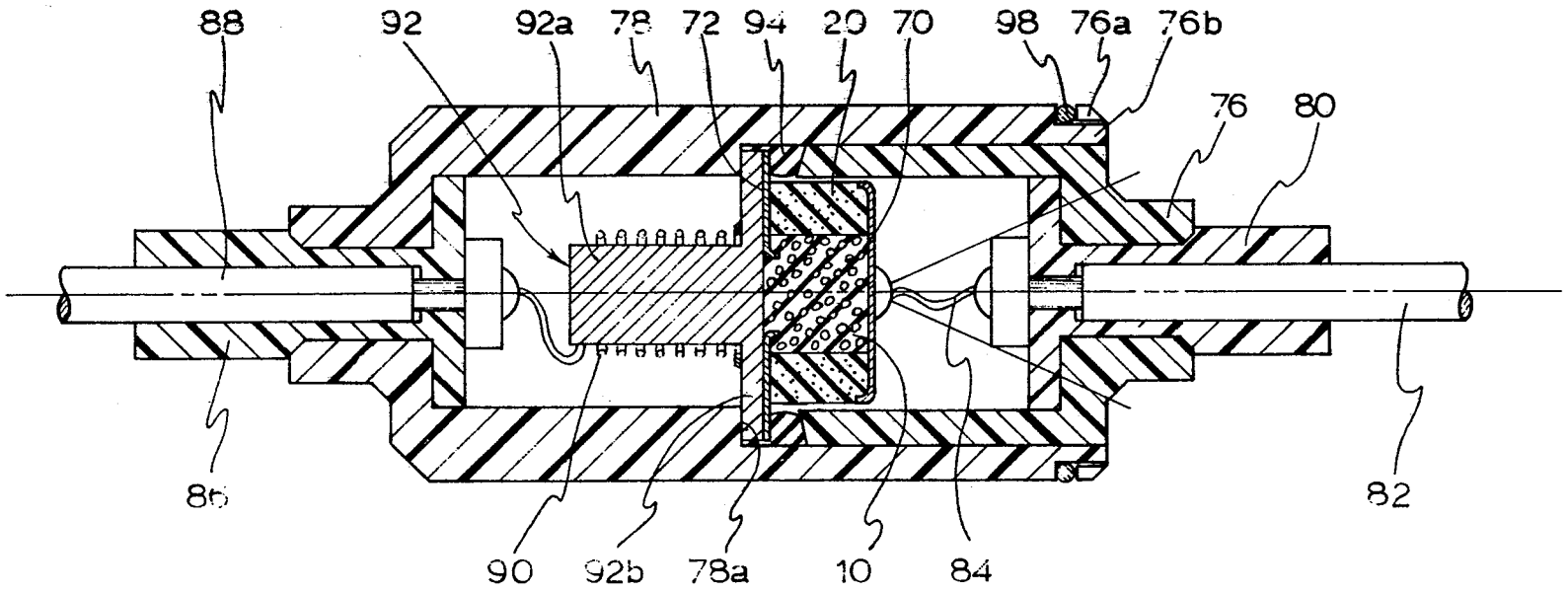
FIG. 16 is a ninth embodiment of the current limiting device in accordance of the teachings of the present invention.

Referring to FIG. 16, shown therein is a ninth embodiment of a current limiting element in accordance to the teachings of the present invention. In FIG. 16 the conductive elastic part 10 takes the form of a relatively short cylinder, is formed by mixing silver-plated conductive metallic particles with silicone rubber. The heating/heat insulating part 20, which is manufactured by mixing a high-resistance powdered metal with silicon rubber, is formed around the circumference of the conductive eleastic part 10. Terminals 70 and 72, which are made of a metallic conductor, are securely attached to both ends of this current limiting element. The current limiting element thus formed is contained in a case consisting of a case stem 76 and a cap 78. The case stem 76 is in the form of a stepped cylinder and is made of plastic or alike. The lead terminal 82 is fastened in the opening at the narrow end and by waterproof packing 80. One end of the lead terminal 82 is connected with the terminal 70 of the current limiting element by lead wire 84 which is soldered to wire 84 which is soldered to lead terminal 82 and terminal 70.

The cap 78 is also a stepped cylinder similar to the case stem 76. Lead terminal 88 is fastened in the opening at one end by waterproof packing 86. One end of an indirect heating coil 90 is soldered to one end of the lead terminal 88. This indirect heating coil 90 is loosely wrapped around the shaft portion 92*a* of a heating part 92. The other end of the coil 90 is soldered to flange portion 82*b* of the heating part 92. It will thus be seen that the current limiting element is held in the case stem 76, while indirect heating coil 90 and the heating part 92 are held in the cap 78. The case is assembled by fitting the cap 78 over the case stem 76. An O-ring 94 is installed between the cap 78 and the case stem 76 so that the watertightness of the case is preserved. The watertightness of the case is to prevent the entrance of dirt, rainwater, etc., when the current limiting element is used in the load circuits of a motorvehicle such as an automobile, etc. When assembled as shown in FIG. 16, the rim of terminal 72 and the flange portion 92*b* of the heating part 92 are pressed against the step 78*a* of the cap 78 by the O-ring 94, and are thus held securely against the case. A number of teeth 78*b*, arranged like the teeth of a comb, are provided in the end surface of the cap 78. A C-ring 98 is inserted into a slot 96 formed by a comb-like teeth 76*a* on the stem 76 which project from between the teeth 78*b*. This securely fastens the case stem 76 and cap 78 together. When thus assembled, the flange portion 92*b* and the terminal 72 of the current limiting element are pressed into contact so that electrical contact is maintained. Accordingly, the current limiting element can be sufficiently heated for all conditions of operation by indirect heating coil 90 even when a relatively low current is flowing in the principal circuit.

In all cases it is understood that the above-described embodiments are merely illustrative but a few of the many possible specific embodiments which represent the application of the principales of the present invention. Numerious and varied other arrangements can be readily devised by those skilled in the art without departing from the spirit and scope of the invention.

I claim:

1. A current limiting element for preventing electrical overcurrent comprising:

a generally elongate principle current conductor means of substantially circular cross-section, said conductor means being made from an elastic insulative material having a positive coefficient of thermal expansion mixed with conductive particles; and a heating/heat insulating member provided about the circumference of said conductor means.

2. A current limiting element according to claim 1 wherein said elastic insulative material is silicone rubber.

3. A current limiting element according to claim 1 wherein said conductive particles are made from a material which does not corrode or oxidize.

4. A current limiting element according to claim 3 wherein said particles are selected from the group consisting of gold, silver and platinum.

5. A current limiting element according to claim 1 wherein said particles are made from a material which forms conductive compounds when it corrodes.

6. A current limiting element according to claim 1 wherein said particles are made from a conductive material which does not corrode plated onto another conductive material.

7. A current limiting element according to claim 1 wherein said heating/heat insulating member comprises an insulative elastic material mixed with particles having a high contact resistance.

8. A current limiting element according to claim 1 wherein said heating/heat insulating member comprises a high resistive material deposited on said conductor means.

9. A current limiting element according to claim 8 wherein said resistive material is carbon black.

10. A current limiting element according to claim 1 further comprising an indirect heating means electrically in parallel with said conductor means and adjacent said heating/heat insulating member.

11. A current limiting element according to claim 10 wherein said current limiting element is disposed within a water tight housing having electrical connection extending through said housing and coupled to said current limiting element at one end.

12. A current limiting element according to claim 1 wherein said conducting particles are made from a material which does not oxidize.

13. A current limiting element according to claim 1 wherein said particles are made from material which forms conductive compounds when it oxidizes.

14. A current limiting element according to claim 1 wherein said particles are made from a conductive material which does not oxidize plated onto another conductive material.

* * * * *